US011828132B2

(12) United States Patent
Hashim et al.

(10) Patent No.: US 11,828,132 B2
(45) Date of Patent: Nov. 28, 2023

(54) INFLATABLE BRIDGE PLUG

(71) Applicant: Saudi Arabian Oil Company, Dhahran (SA)

(72) Inventors: Ahmed Hashim, Hofuf (SA); Abdul Halim Ab Hamid, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/682,083

(22) Filed: Feb. 28, 2022

(65) Prior Publication Data

US 2023/0272688 A1 Aug. 31, 2023

(51) Int. Cl.
*E21B 33/127* (2006.01)

(52) U.S. Cl.
CPC ..... *E21B 33/1277* (2013.01)

(58) Field of Classification Search
CPC ... E21B 33/134; E21B 33/127; E21B 33/1275
See application file for complete search history.

(56) References Cited

U.S. PATENT DOCUMENTS

| | | | |
|---|---|---|---|
| 5,220,959 | A | 6/1993 | Vance, Sr. |
| 5,711,372 | A | 1/1998 | Stokley |
| 5,925,879 | A | 7/1999 | Hay |
| 6,073,692 | A | 6/2000 | Wood et al. |
| 6,302,214 | B1 | 10/2001 | Carmichael et al. |
| 6,431,274 | B1 | 8/2002 | Nowlin et al. |
| 6,478,088 | B1 | 11/2002 | Hansen et al. |
| 7,322,422 | B2 | 1/2008 | Patel |
| 7,325,621 | B2 | 2/2008 | Naquin, Sr. et al. |
| 7,404,437 | B2 | 7/2008 | Brezinski et al. |
| 8,091,641 | B2 | 1/2012 | Gambier et al. |
| 8,807,211 | B2 | 8/2014 | Heijnen et al. |

(Continued)

FOREIGN PATENT DOCUMENTS

| | | | |
|---|---|---|---|
| AU | 628540 | B2 | 9/1992 |
| CN | 106085390 | A | 11/2016 |

(Continued)

OTHER PUBLICATIONS

Baker Hughes; "Thru-Tubing Intervention" Baker Hughes Company, 2020; pp. 1-112.

(Continued)

*Primary Examiner* — Robert E Fuller
(74) *Attorney, Agent, or Firm* — Bracewell LLP; Constance G. Rhebergen; Brian H. Tompkins

(57) ABSTRACT

A well plugging technique that includes a downhole plug system to be disposed downhole in a well and including a plug bladder system including an inflatable bladder (to be inflated with a resin) and a check valve (to facilitate flow of the resin into, and inhibit back flow of the resin out of, the bladder), and a plug deployment system including a resin chamber to house the resin and a resin deployment system to urge the resin to flow from the resin chamber, through the check valve and into the inflatable bladder while the downhole plug system is disposed downhole in the well, to inflate the plug bladder system into sealing contact with a surrounding downhole portion of the well. The resin including a hardening resin adapted to harden inside of the inflatable bladder to form a hardened plug downhole in the well.

13 Claims, 6 Drawing Sheets

(56) References Cited

U.S. PATENT DOCUMENTS

| | | | | |
|---|---|---|---|---|
| 9,303,485 | B2 | 4/2016 | Hiecker et al. | |
| 9,316,085 | B2 | 4/2016 | Fuglestad | |
| 9,677,372 | B2 | 6/2017 | Smith et al. | |
| 9,816,345 | B2 | 11/2017 | Freeman et al. | |
| 10,619,447 | B2 | 4/2020 | Kelley et al. | |
| 11,066,898 | B2 | 7/2021 | Cabot et al. | |
| 11,105,181 | B2 | 8/2021 | Powell et al. | |
| 2003/0075342 | A1* | 4/2003 | Gunnarsson | E21B 23/06 166/387 |
| 2004/0216871 | A1 | 11/2004 | Mendez et al. | |
| 2005/0023003 | A1* | 2/2005 | Echols | E21B 33/12 166/387 |
| 2016/0251938 | A1 | 9/2016 | Murray et al. | |
| 2018/0216437 | A1 | 8/2018 | Shafer | |
| 2021/0079754 | A1* | 3/2021 | Yang | E21B 33/12 |

FOREIGN PATENT DOCUMENTS

| | | | | |
|---|---|---|---|---|
| CN | 107939335 | A | 4/2018 | |
| CN | 111075393 | A | 4/2020 | |
| DE | 3526557 | A1 | 2/1987 | |
| EP | 1840324 | A1 | 10/2007 | |
| GB | 2403744 | A | 1/2005 | |
| WO | WO-2004065758 | A1 * | 8/2004 | E21B 33/1243 |
| WO | 2014172715 | A1 | 10/2014 | |

OTHER PUBLICATIONS

IPI Packers; "Retrievable Inflatable Bridge Plug (RIBP)" available at: www.ipipackers.com; p. 1.

IPI Packers; "Thru-Tubing Retrievable Inflatable Bridge Plug (TT-RIBP)" available at: www.ipipackers.com; p. 1.

Wellpro Group; "Inflatable Product Catalogue" pp. 1-21.

Wilson, Stuart et al.; "Inflatable Packers in Extreme Environments" (abstract only) SPE-89529-MS, SPE/ICoTA Coiled Tubing Conference and Exhibition, Houston, TX, Mar. 23, 2007; pp. 1-2.

International Search Report and Written Opinion for International Application No. PCT/US2023/013797, report dated May 10, 2023; pp. 1-14.

* cited by examiner

INFLATABLE BRIDGE PLUG

FIELD

Embodiments relate generally to developing wells, and more particularly to an inflatable well plug system.

BACKGROUND

A well typically includes a wellbore (or a "borehole") that is drilled into the earth to provide access to a geologic formation that resides below the earth's surface (or a "subsurface formation"). A well often facilitates the extraction of natural resources, such as hydrocarbons and water, from a subsurface formation, facilitates the injection of substances into the subsurface formation, or facilitates the evaluation and monitoring of the subsurface formation. In the petroleum industry, hydrocarbon wells are often drilled to extract (or "produce") hydrocarbons, such as oil and gas, from subsurface formations.

Developing a hydrocarbon well for production typically involves a drilling stage, a completion stage and a production stage. The drilling stage involves drilling a wellbore into a portion of the formation that is expected to contain hydrocarbons (often referred to as a "hydrocarbon reservoir" or a "reservoir"). The drilling process is often facilitated by a drilling rig that provides for a variety of drilling operations, such as operating a drill bit to cut (or "drill") the wellbore. The completion stage involves operations for making the well ready to produce hydrocarbons, such as installing casing, installing production tubing, installing valves for regulating production flow, or pumping substances into the well to fracture, clean or otherwise prepare the well and reservoir to produce hydrocarbons. The production stage involves producing hydrocarbons from the reservoir by way of the well. During the production stage, the drilling rig is typically replaced with a production tree that includes valves that are operated to, for example, regulate production flow rate and pressure. The production tree normally includes an outlet that is connected to a distribution network of midstream facilities, such as tanks, pipelines or transport vehicles, that transport production from the well to downstream facilities, such as refineries or export terminals.

Successfully developing a hydrocarbon well can include a variety of challenges that need to be addressed. During well completion and production operations, for example, a well operator may need to isolate downhole portions of a well from one another. This if often accomplished by installing a plug (often referred to as a "bridge plug") in a well to isolate regions (or "zones") located above and below the plug. For example, a bridge plug may be installed at a given depth downhole in a well to isolate an upper zone of the well (located above the plug) from a lower zone of the well (located below the plug). In some instances, a plug is used to isolate a zone from conditions or operations taking place in the other zone. For example, a plug may be used to seal-off a lower zone of the well while completion operations are conducted in an upper zone of the well.

SUMMARY

Bridge plugs can be an important tool in developing a well. For example, in a workover operation a bridge plug may be installed (or "set") in production tubing in a wellbore of the well to isolate an upper region (or "zone") of the tubing (located above the plug) from a lower region of the tubing (located below the plug). This may, for example, block production fluids from moving up the production tubing, which can, in turn, allow workover operations in the upper zone without a threat of production fluids migrating into the upper zone or workover fluids migrating into the lower zone. In some instances, a "kill fluid" (e.g., mud) is deposited on top of the bridge plug to help offset and contain pressure in the lower zone. For example, a column of mud may be deposited into the upper zone, on top of the bridge plug, so that the weight of the mud acts against a top side of the bridge plug to offset production pressure, or other fluid pressures, acting on the bottom side of the bridge plug.

Although bridge plugs can be an effective tool for operating a well, they can be difficult to install and remove. For example, if it is desirable to install a bridge plug at a given depth inside production tubing and there is a restriction, such as a relatively small diameter section located at or above the given depth, the width of the bridge plug and associated components may have difficulty fitting through the restriction. This can prevent the bridge plug from being advanced to the given depth or can result in damage to the plug or tubing if the plug is advanced (or "run") into the restriction. In many instances, traditional bridge plugs have a relatively a-large diameter while being run (or "running outer diameter" or "running OD") (e.g., about a 3.6 inch running OD) for use in relatively large diameter tubing (e.g., in production tubing having an internal diameter (ID) of about 3.9 inches). Thus, if there is a restriction that is about 3.6 inches or less, it may be difficult or impossible to advance a traditional bridge plug though the restriction. Or, if the production tubing is relatively small, with an ID of about 3.6 inches or less, a traditional bridge plug may not be suitable for use in the tubing. Regarding difficulty of removal, if a bridge plug is installed downhole and there is a need to remove the plug, the plug removal operation may require running complex tools (e.g., coiled tubing) downhole to capture and retrieve the plug. Despite the costs and time requirements, retrieval operations generally pose high risks of complications and failure.

Provided in some embodiments is an inflatable bridge plug system that can provide for efficient and effective bridge plug installation and removal. In some embodiments, the bridge plug includes an inflatable bridge plug that can be installed in a well to isolate upper and lower regions located above and below the installed plug, respectively. For example, the inflatable bridge plug may be installed downhole, inside production tubing of a well, at a depth (or "plug depth") of about 2000 feet (ft) to isolate an upper region of the inside of the production tubing (located above the plug depth of 2000 ft) from a lower region of the inside of the production tubing (located below the plug depth of 2000 ft). In some embodiments, the inflatable bridge plug system employs an inflatable bladder that can be run in a deflated state to a plug depth, where it can then be filled with a resin to inflate the bladder into sealing contact with a surrounding surface. For example, the inflatable bridge plug system may include a deflated bladder packaged in a relatively small profile tool that can be run downhole, inside the production tubing of a well to the plug depth of 2000 ft. Once positioned at or near the plug depth, the bladder can be filled with a resin that inflates the bladder into sealing contact with a surrounding internal surface of the production tubing. The resin may be a "hardening" resin that hardens inside the bladder over time (e.g., over the course of an hour), such that the inflated bladder forms a "hardened" bridge plug that isolates the upper and lower regions of the production tubing from one another. Such an inflatable bridge plug may provide a relatively small profile that allows the tool and bladder to be run through downhole areas having a relatively small cross-section, and the bladder have a relatively large, inflated profile that enables the bridge plug to be installed in locations with a relatively large cross-section. For example, an inflatable plug system (e.g., including the tool housing the uninflated bladder) may have an approximately 2 inch un-inflated/running OD that enables the plug system to be run through relatively small passages (e.g., through tubing and restrictions having diameters in a range of about 2-3.5 inches) and the bladder may have an inflated/set OD of about 4 inches that enables the bridge plug to be installed in a region with relatively large cross-sections (e.g., in tubing having an internal diameter (ID) of about 3.5-4 inches).

Provided in some embodiments is a well plug system that includes the following: a downhole plug system adapted to be disposed downhole in a well, the downhole plug system including: a plug bladder system including: an inflatable bladder adapted to be inflated with a resin; and a check valve adapted to facilitate flow of the resin into the inflatable bladder and to inhibit back flow of the resin out of the inflatable bladder; and a plug deployment system including: a resin chamber adapted to house the resin; and a resin deployment system adapted to urge the resin to flow from the resin chamber, through the check valve and into the inflatable bladder while the downhole plug system is disposed downhole in the well to inflate the plug bladder system into sealing contact with a surrounding downhole portion of the well, the resin including a hardening resin adapted to harden inside of the inflatable bladder to form a hardened plug downhole in the well.

In some embodiments, the plug deployment system is adapted to detach from the plug bladder system such that the plug deployment system can be detached from the plug bladder system and retrieved from the well with the plug bladder system remaining inflated and disposed downhole in the well. In certain embodiments, the plug deployment system includes a resin pressure sensor adapted to measure a pressure of the resin, and where a control system is adapted to: determine, based on a measurement of the pressure of the resin obtained by way of the resin pressure sensor, that the pressure of the resin satisfies a resin pressure threshold, and in response to determining that the pressure of the resin satisfies the resin pressure threshold, inhibit flow of the resin into the inflatable bladder. In some embodiments, the resin deployment system includes a piston adapted to be advanced to urge the resin to flow from the resin chamber, through the check valve and into the inflatable bladder. In certain embodiments, the resin deployment system includes a motive device adapted to regulate advancement of the piston. In some embodiments, the plug deployment system includes an onboard controller adapted to control operation of the motive device to regulate advancement of the piston. In certain embodiments, the resin includes a two-part hardening composition including a curing agent component and a resin component, where the downhole plug system is adapted to isolate the curing agent component from the resin component while the resin is housed in resin chamber, and the downhole plug system is adapted to combine the curing agent component and the resin component such that the resin hardens inside the inflatable bladder. In some embodiments, the well plug system includes a well control system coupled to the plug deployment system by way of a tether and adapted to control operation of the plug deployment system. In certain embodiments, the well includes a hydrocarbon well including downhole tubing disposed in a wellbore of the hydrocarbon well and where the downhole plug system is adapted to be disposed in the downhole tubing and the plug bladder system is adapted to be inflated into sealing contact with an interior surface of the downhole tubing.

Provided in some embodiments is a method of plugging a well that includes the following: disposing a downhole plug system downhole in a well, the downhole plug system including: a plug bladder system including: an inflatable bladder adapted to be inflated with a resin; and a check valve adapted to facilitate flow of the resin into the inflatable bladder and to inhibit back flow of the resin out of the inflatable bladder; a plug deployment system including: a resin chamber adapted to house the resin; and a resin deployment system; and controlling the plug deployment system to urge the resin to flow from the resin chamber, through the check valve and into the inflatable bladder while the downhole plug system is disposed downhole in the well to inflate the plug bladder system into sealing contact with a surrounding downhole portion of the well, the resin including a hardening resin adapted to harden inside of the inflatable bladder to form a hardened plug downhole in the well, where the resin hardens inside of the inflatable bladder to form a hardened plug downhole in the well.

In some embodiments, the method further includes detaching the plug deployment system from the plug bladder system, and retrieving the plug deployment system from the well, leaving the plug bladder system inflated and disposed downhole in the well. In certain embodiments, the plug deployment system includes a resin pressure sensor adapted to measure a pressure of the resin, and the method further includes: determining, based on a measurement of the pressure of the resin obtained by way of the resin pressure sensor, that the pressure of the resin satisfies a resin pressure threshold, and in response to determining that the pressure of the resin satisfies the resin pressure threshold, inhibiting flow of the resin into the inflatable bladder. In some embodiments, the resin deployment system includes a piston, and controlling the plug deployment system to urge the resin to flow from the resin chamber includes advancing the piston to urge the resin to flow from the resin chamber, through the check valve and into the inflatable bladder. In certain embodiments, the resin deployment system includes a motive device, and where advancing the piston includes controlling the motive device to regulate the advancement of the piston. In some embodiments, the resin includes a two-part hardening composition including a curing agent component and a resin component, where the downhole plug system isolates the curing agent component from the resin component while the resin is housed in resin chamber, and the downhole plug system combines the curing agent component and the resin component such that the resin hardens inside the inflatable bladder. In certain embodiments, the well includes a hydrocarbon well including downhole tubing disposed in a wellbore of the hydrocarbon well, where disposing the downhole plug system downhole in the well includes disposing the downhole plug system in the downhole tubing, where the plug bladder system inflated into sealing contact with an interior surface of the downhole tubing, and where the hardening of the resin forms a hardened plug in the downhole tubing. In some embodiments, the method further includes conducting a well operation in the well with the hardened plug downhole in the well. In certain embodiments, the method further includes conducting a plug removal operation including drilling through the hardened plug.

Provided in some embodiments is a non-transitory computer readable storage medium including program instructions stored thereon that are executable by a processor to perform the methods describe above. The non-transitory computer readable storage medium may include program instructions stored thereon that are executable by a processor to perform the following operations for plugging a well: controlling disposing of a downhole plug system downhole in a well, the downhole plug system including: a plug bladder system including: an inflatable bladder adapted to be inflated with a resin; and a check valve adapted to facilitate flow of the resin into the inflatable bladder and to inhibit back flow of the resin out of the inflatable bladder; and a plug deployment system including: a resin chamber adapted to house the resin; and a resin deployment system; and controlling the plug deployment system to urge the resin to flow from the resin chamber, through the check valve and into the inflatable bladder while the downhole plug system is disposed downhole in the well to inflate the plug bladder system into sealing contact with a surrounding downhole portion of the well, the resin including a hardening resin adapted to harden inside of the inflatable bladder to form a hardened plug downhole in the well, where the resin is adapted to harden inside of the inflatable bladder to form a hardened plug downhole in the well. In some embodiments, the operations further include controlling detachment of the plug deployment system from the plug bladder system and controlling retrieving of the plug deployment system from the well to leave the plug bladder system inflated and disposed downhole in the well.

Figure 1:
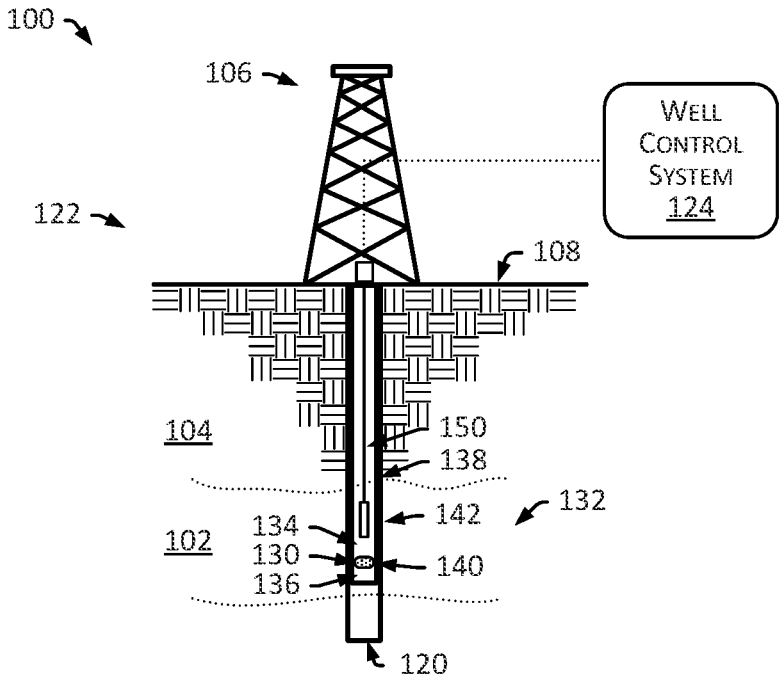
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. The drawings and the detailed descriptions are not intended to limit the disclosure to the form disclosed, but are intended to disclose modifications, equivalents, and alternatives falling within the scope of the disclosure as defined by the claims.

DETAILED DESCRIPTION

Described are embodiments of novel systems and method for employing an inflatable bridge plug. In some embodiments, the bridge plug includes an inflatable bridge plug that can be installed in a well to isolate upper and lower regions located above and below the installed plug, respectively. For example, the inflatable bridge plug may be installed downhole, inside production tubing of a well, at a depth (or "plug depth") of about 2000 feet (ft) to isolate an upper region of the inside of the production tubing (located above the plug depth of 2000 ft) from a lower region of the inside of the production tubing (located below the plug depth of 2000 ft). In some embodiments, the inflatable bridge plug system employs an inflatable bladder that can be run in a deflated state to a plug depth, where it can then be filled with a resin to inflate the bladder into sealing contact with a surrounding surface. For example, the inflatable bridge plug system may include a deflated bladder packaged in a relatively small profile tool that can be run downhole, inside the production tubing of a well to the plug depth of 2000 ft. Once positioned at or near the plug depth, the bladder can be filled with a resin that inflates the bladder into sealing contact with a surrounding internal surface of the production tubing. The resin may be a "hardening" resin that hardens inside the bladder over time (e.g., over the course of an hour), such that the inflated bladder forms a "hardened" bridge plug that isolates the upper and lower regions of the production tubing from one another. Such an inflatable bridge plug may provide a relatively small profile that allows the tool and bladder to be run through downhole areas having a relatively small cross-section, and the bladder have a relatively large, inflated profile that enables the bridge plug to be installed in locations with a relatively large cross-section. For example, an inflatable plug system (e.g., including the tool housing the uninflated bladder) may have an approximately 2 inch un-inflated/running OD that enables the plug system to be run through relatively small passages (e.g., through tubing and restrictions having diameters in a range of about 2-3.5 inches) and the bladder may have an inflated/set OD of about 4 inches that enables the bridge plug to be installed in a region with relatively large cross-sections (e.g., in tubing having an internal diameter (ID) of about 3.5-4 inches).

FIG. 1 is a diagram that illustrates a well environment 100 in accordance with one or more embodiments. In the illustrated embodiment, the well environment 100 includes a reservoir ("reservoir") 102 located in a subsurface formation ("formation") 104, and a well system ("well") 106.

The formation 104 may include a porous or fractured rock formation that resides beneath the earth's surface (or "surface") 108. The reservoir 102 may be a hydrocarbon reservoir defined by a portion of the formation 104 that contains (or that is at least determined or expected to contain) a subsurface pool of hydrocarbons, such as oil and gas. The formation 104 and the reservoir 102 may each include layers of rock having varying characteristics, such as varying degrees of permeability, porosity, and fluid saturation. In the case of the well 106 being operated as a production well, the well 106 may be a hydrocarbon production well that is operable to facilitate the extraction of hydrocarbons (or "production"), such as oil or gas, from the reservoir 102. In the case of the well 106 being operated as an injection well, the well 106 may be operable to facilitate the injection of substances, such as water or gas, into the reservoir 102.

The well 106 may include a wellbore 120, an inflatable bridge plug system (or "well plug system") 122 and a well control system ("control system") 124. The wellbore 120 may be a bored hole that extends from the surface 108 into a target zone of the formation 104, such as the reservoir 102. The wellbore 120 may be created, for example, by a drill bit of a drilling system of the well 106 boring through the formation 104. An upper end of the wellbore 120 (e.g., located at or near the surface 108) may be referred to as the "up-hole" end of the wellbore 120. A lower end of the wellbore 120 (e.g., terminating in the formation 104) may be referred to as the "downhole" end of the wellbore 120.

In some embodiments, the well plug system 122 includes devices that facilitate installation of a bridge plug 130 downhole, in the wellbore 120. In the illustrated embodiment, the well plug system 122 includes a downhole plug system (or "well plug tool") 132 that is employed to install (or "set") the bridge plug 130 at a given depth (or "plug depth") in the wellbore 120 of the well 106. The installed bridge plug 130 may form a barrier that isolates an upper region (or "upper zone") 134 of the wellbore 120 (located above the installed bridge plug 130) from a lower region (or "lower zone") 136 of the wellbore 120 (located below the installed bridge plug 130). For example, the bridge plug 130 may be installed in an open-holed portion of the wellbore 120 at a plug depth of about 2000 feet, such that the installed bridge plug 130 seals against the walls of the wellbore 120 at the plug depth to form barrier that isolates an upper region 134 of the wellbore 120 (located above 2000 ft) from a lower region 136 of the wellbore 120 (located below 2000 ft). In some embodiments, the wellbore 120 includes a tubular 138 installed therein, such as casing, production tubing or another downhole tubular, and the bridge plug 130 is installed inside the tubular 138 to form a barrier that isolates an upper region (or "upper zone") 134 of the tubular 138 from a lower region (or "lower zone") 136 of the tubular 138. For example, the wellbore 120 may include a production tubing type tubular 138 installed therein, and the bridge plug 130 is installed downhole, inside the tubular 138 at a plug depth of about 2000 ft, such that the installed bridge plug 130 forms a barrier that isolates an upper region 134 of the inside of the tubular 138 (located above 2000 ft) from a lower region 136 of the inside of the tubular 138 (located below 2000 ft).

In some embodiments, a weighted substance is deposited on top of the installed bridge plug 130 to offset or contain pressure in a lower region 136. For example, a column of a "kill fluid" (e.g., mud) may be deposited into the upper region 134, on top of the installed bridge plug 130 such that the weight of the kill fluid acts against a top side of the installed bridge plug 130 to offset pressure (e.g., production or other fluid pressure) acting on the bottom side of the installed bridge plug 130.

In some embodiments, the installed bridge plug 130 is uninstalled (or "removed") to facilitate fluid communication between the upper region 134 and the lower region 136 isolated by the installed bridge plug 130. For example, a plug removal operation may be conducted that includes lowering a drilling tool into the wellbore 120 (e.g., into the tubular 138) and advancing the drilling tool to drill through (or "drill-out") the installed bridge plug 130. The resulting debris of the drilling operation, including parts of the bridge plug 130, may be carried up and out of the wellbore 120 by way of drilling fluid (e.g., drilling fluid circulated through the drilling tool). In some embodiments, the bridge plug 130 is formed of materials that facilitate drilling of the bridge plug 130. For example, the bridge plug 130 may not contain abrasive components, such as metal, that could cause excessive wear or breakage of the drilling tool.

In the illustrated embodiment, the well plug tool 132 includes a plug bladder system 140 and a plug deployment system 142. As described in further detail with regard to at least FIGS. 2-3E, in some embodiments, the plug bladder system 140 includes an inflatable bladder that can be inflated with a resin to form the bridge plug 130, and the plug deployment system 142 includes devices operable to inflate the bladder with the resin.

In some embodiments, the well plug tool 132 (including the inflatable bladder) is run downhole to a plug depth and the plug deployment system 142 is operated to inflate the bladder into sealing contact with a surrounding surface at the plug depth. For example, the well plug tool 132 (including the inflatable bladder packaged in a deflated state) may be run downhole, inside the tubular 138 to a plug depth of about 2000 ft, and the plug deployment system 142 may be operated fill the bladder with a resin to inflate the bladder into sealing contact with a surrounding internal surface of the tubular 138 at the plug depth.

In some embodiments, the bladder is inflated with a resin that hardens over time. In such an embodiment, the resin introduced into the bladder may harden within the bladder to form an inflated-hardened bladder that forms a "hardened" bridge plug 130. For example, the resin may include a two-part hardening composition (e.g., an epoxy) that includes a curing agent component (e.g., a hardener) and a resin component (e.g., an epoxy resin). In such an embodiment, the plug deployment system 142 may include a resin chamber that houses the curing agent component and the resin component in isolation from one another prior to the resin being introduced into the bladder, such that the resin does not activate into a hardened state while housed in the resin chamber. The plug deployment system 142 may provide for combining the curing agent component and the resin component (e.g., mixing of the hardener and epoxy resin) to activate hardening (or "curing") of the resin at or near that time that they are introduced into the bladder. The resulting "activated" resin may, then, harden (or "cure") inside the bladder over time (e.g., over the course of one hour) to form a "hardened" bridge plug 130. Continuing with the above example, the hardened (or "cured") bridge plug 130 may form an effective barrier that isolates the upper region 134 of the inside of the tubular 138 (located above 2000 ft) from the lower region 136 of the inside of the tubular 138 (located below 2000 ft). Although certain embodiments are described as employing an epoxy type hardening resin, embodiments can include other suitable materials that can provide for flow into, and hardening within, the bladder. For example, embodiments may include use of a cementitious material (e.g., cement) that is mixed with water, to facilitate the flow of the mixed material into the bladder, where it can harden to form the hardened (or "cured") bridge plug 130.

In some embodiments, the well plug system 122 includes a tether 150. The tether 150 may provide a physical connection between the well plug tool 132 and other components of the well 106, such as the well control system 124. For example, the tether 150 may include a wireline, or other cabling or conduit, that includes a cabled connection between the well plug tool 132 and surface components, including the well control system 124. In some embodiments, the tether 150 may provide for lowering, lifting, controlling or powering of the well plug system 122. For example, the tether 150 may include a wireline that includes a cabled connection that provides physical support for lowing or raising the well plug system 122 in the wellbore 120 of the well 106 or includes communication lines for communicating data signals or electrical power between the well control system 124 and the well plug system 122.

In some embodiments, the well control system 124 is operable to control various operations of the well 106, including well plugging operations for installing or removing the bridge plug 130. The well control system 124 may include a well system memory and a well system processor that are operable to perform some or all the various processing and control operations of the well control system 124 described here. In some embodiments, the well control system 124 includes a computer system that is the same as or similar to that of computer system 1000 described with regard to at least FIG. 5.

Figure 2:
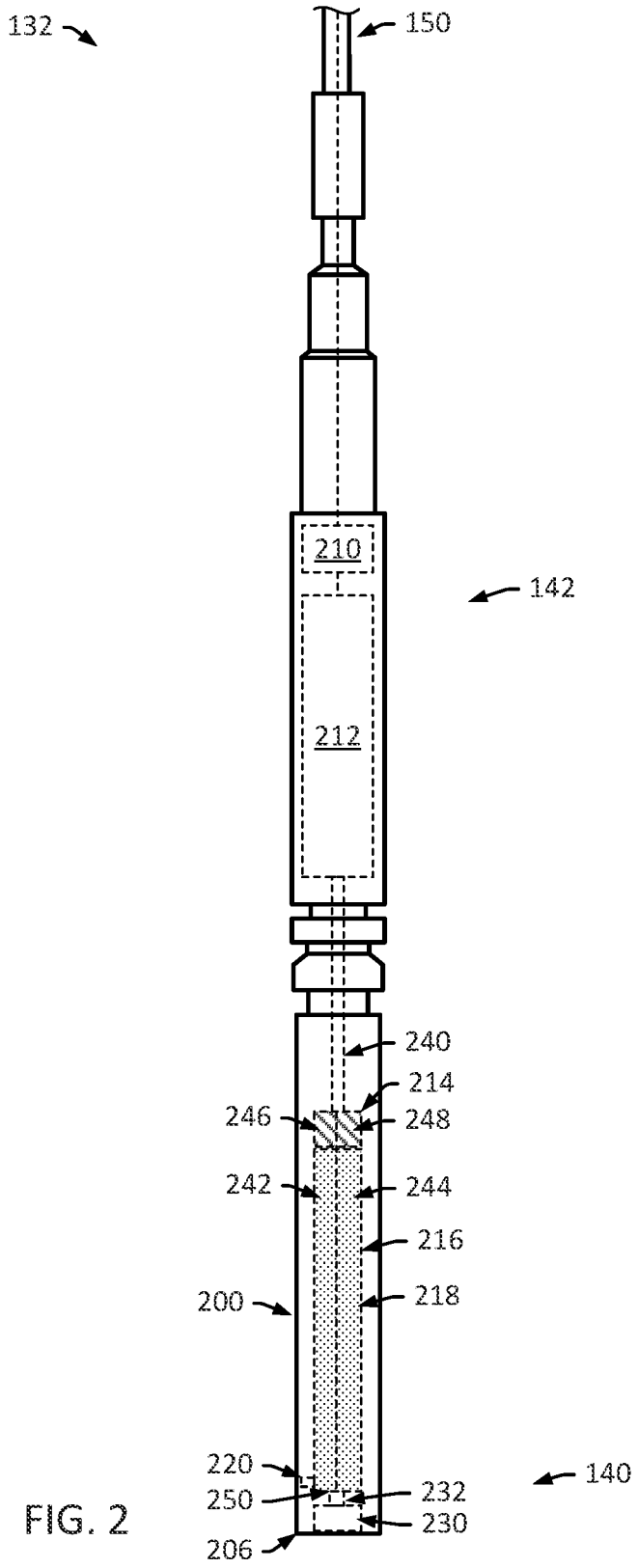
FIG. 2 is a diagram that illustrate an example bridge plug system in accordance with one or more embodiments.

FIG. 2 is a diagram that illustrates components of a well plug system 122 in accordance with one or more embodiments. In the illustrated embodiment, the well plug system 122 includes well plug tool 132 having a tool body (or "housing") 200 housing a plug deployment system 142 and a plug bladder system 140 in a running configuration (e.g., with the bladder 230 deflated inside of the housing 200). The plug deployment system 142 includes a local control system (or "onboard controller") 210, a motive device 212, a piston 214, a resin chamber 216 (for housing a resin 218), and a resin pressure sensor 220. The plug bladder system 140 includes an inflatable bladder 230 and a bladder valve 232.

In some embodiments, the onboard controller 210 is operable to control various operations of the well plug tool 132, including operations of the plug deployment system 142 to deploy (e.g., inflate and disconnect from) the plug bladder system 140. The onboard controller 210 may include memory and a processor that are operable to perform some or all the various processing and control operations of the plug deployment system 142 described here. In some embodiments, the onboard controller 210 receives operational commands and executes them. For example, the onboard controller 210 may receive a command (e.g., from the well control system 124 by way of the tether 150) to deploy the plug bladder system 140 and, in response to receiving the command, execute the command by operating the motive device 212 to advance the piston 214 to urge resin 218 from the resin chamber 216, through the bladder valve 232 and into the inflatable bladder 230 to inflate the bladder 230, monitor a resin pressure measured by the resin pressure sensor 220, determine when the resin pressure meets or exceeds a resin pressure threshold (e.g., 200 pounds per square inch (psi)), and, in response to determining that the pressure meets or exceeds the resin pressure threshold, control the motive device 212 to stop advancement of the piston 214 to stop further inflation of the bladder 230 with resin 218. The other portions of the well plug tool 132 (e.g., including the plug deployment system 142) may be moved upward in the well 106 (e.g., by retraction of the tether 150) to disconnect those portions of the well plug tool 132 from the plug bladder system 140, thereby leaving the inflated bladder 230 installed in the well 106 at the plug depth. In some embodiments, the onboard controller 210 includes a computer system that is the same as or similar to that of computer system 1000 described with regard to at least FIG. 5.

In some embodiments, the motive device 212 is a device operable to provide for advancement of the piston 214. For example, the motive device may be operable to advance or retract a stem 240 coupled to the piston 214, such that operation of the motive device 212 can advance the stem 240 and the piston 214 downward to force (or "push") the resin 218 from the resin chamber 216, through the bladder valve 232 and into the inflatable bladder 230 to inflate the bladder 230, or can retract the stem 240 and the piston 214 upward. In some embodiments, the motive device 212 includes a motor having drive gearing (e.g., a pinion) that engages complementary driven gearing (e.g., a rack) of a stem 240 coupled to the piston 214, such that operation of the motive device 212 provides linear motion that advances or retracts the stem 240 and the piston 214. In some embodiments, the motive device includes a hydraulic pump that generates hydraulic pressure to advance or retract the stem 240 and the piston 214.

In some embodiments, the resin chamber 216 is a container operable to house the resin 218. During a deployment operation, the piston 214 may be advanced to urge (e.g., "push" or "force") the resin 218 to be expelled from the resin chamber 216 through an outlet 250 of the resin chamber 216. As described, the outlet 250 may be coupled to the plug bladder system 140 such that the expelled resin 218 is routed through the bladder valve 232 and into the inflatable bladder 230 to inflate the bladder 230. In some embodiments, the resin chamber 216 provides for maintaining separation (or "isolation") of components of a multi-component hardening resin 218, to inhibit the resin 218 from activating and hardening in the resin chamber 216, before it is injected into the inflatable bladder 230. For example, the resin chamber 216 may include a first chamber 242 for housing a curing agent component and a second chamber 244 for a resin component. The piston 214 may include first and second piston elements 246 and 248 that are operable to force (or "push") the resin 218 from the first and second resin chambers 242 and 244. In such an embodiment, the curing agent component and the resin component may remain isolated from one another until at or near the point where they exit their respective chambers 242 and 244 and the outlet 250, where they are then mixed (e.g., at or near the point of entering the plug bladder system 140) to activate hardening (or "curing") of the resin 218 inside the bladder 230.

In some embodiments, the resin pressure sensor 220 is operable to measure a pressure of the resin 218. For example, the resin pressure sensor 220 may be located at or near the outlet 250 to sense pressure of the resin 218 as it is being expelled into the plug bladder system 140. This "resin pressure" may correspond to the pressure of the resin 218 inside the bladder 230, which can provide an indication of the state of the inflation of the bladder 230. For example, it can be expected that the resin pressure will increase as the bladder 230 is inflated with resin, and it can be determined that the bladder 230 is sufficiently inflated (e.g., in sealing contact with the surrounding surfaces) when the resin pressure measured by resin pressure sensor 220 exceeds a predefined resin pressure threshold (e.g., 200 psi). As described, in some embodiments, a control system (e.g., the onboard controller 210) may receive and process the resin pressure measurements from the resin pressure sensor 220 to determine whether the resin pressure meets or exceeds the resin pressure threshold, and may, in response to determining that the resin pressure meets or exceeds the resin pressure threshold, control the plug deployment system 142 to stop inflating the bladder 230 with resin 218.

In some embodiments, the bladder valve 232 is operable to facilitate flow of the resin 218 into the inflatable bladder 230 and to inhibit back flow of the resin 218 out of the inflatable bladder 230. For example, the bladder valve 232 may be a check valve that is operable to allow the resin 218 to flow into the bladder 230 through the check valve and block or otherwise inhibit the flow (or "back-flow") of the resin 218 out of the bladder 230 through the check valve. In such an embodiment, resin 218 may flow from the resin chamber 216, through the check valve and into the inflatable bladder 230, where the resin 218 is retained in the bladder 230 by the check valve. In some embodiments, the bladder valve 232 includes a relief valve that can be employed to release pressure in the bladder 230. In such an embodiment, the relief valve may be opened, for example, if a problem is encountered during inflation, to deflate the bladder 230 so that the bladder 230 can be retrieved, repositioned or reinflated before the resin 218 fully hardens (or "cures") in the bladder 230. In some embodiment, the bladder valve 232 provides for coupling of the plug bladder system 140 to the plug deployment system 142. For example, the bladder valve 232 may include a connector (e.g., a snap connector) that can be selectively coupled and decoupled from a complementary connector of the outlet 250 of the plug deployment system 142. The connector may be connected during running of the well plug tool 132 and inflation of the bladder 230 and may be disconnected after the bladder 230 is inflated with resin 218, to enable the well plug tool 132 to be retrieved from the well 106 with the inflated bladder 230 remaining installed in the well 106, where it can fully harden (or "cure").

In some embodiments, the inflatable bladder 230 is an expandable container. For example, the inflatable bladder 230 may include an expandable container made of a flexible material, such as rubber. In some embodiments, the inflatable bladder 230 can be provided in a first, uninflated state that enables the inflatable bladder 230 be housed within the housing 200 of the well plug tool 132, and can be inflated to achieve a second, inflated state having a size and shape that is capable of sealing engaging with surrounding portions of the well 106. For example, the inflatable bladder 230 may be a hollow spherical or donut shaped container made of a flexible material (e.g., rubber) that in a first, uninflated state can be folded (or "packed") into a relatively small volume that enables the inflatable bladder 230 be housed (or "stuffed") within the downhole end 206 of the housing 200 of the well plug tool 132 (e.g., having an external dimeter of about 2 in), and that can be inflated (e.g., using the resin 218) to achieve a second, inflated state where the inflatable bladder 230 takes on a hollow spherical or donut shape having an outer diameter (e.g. about 4 in or greater) that is capable of making sealing engaging with surrounding portions of the well 106 at the plug depth (e.g., with a surrounding internal surface of the tubular 138 having an internal diameter of about 3.5-4 in). In some embodiments, the inflatable bladder 230 is formed of an elastomeric material that facilitates deformation of the inflatable bladder 230 into sealing contact with surrounding surfaces and that is suitable for use in downhole environments. For example, the inflatable bladder 230 may be formed of a rubber material, such as Nitril (NBR) or Viton® (Fluorocarbon rubber). Such rubber material may provide for deformation of the bladder (when inflated) into sealing contact with surrounding surfaces and may be capable of withstanding the internal threshold resin pressure in combination with exposure to downhole temperatures, pressures and fluids.

Figure 3A:
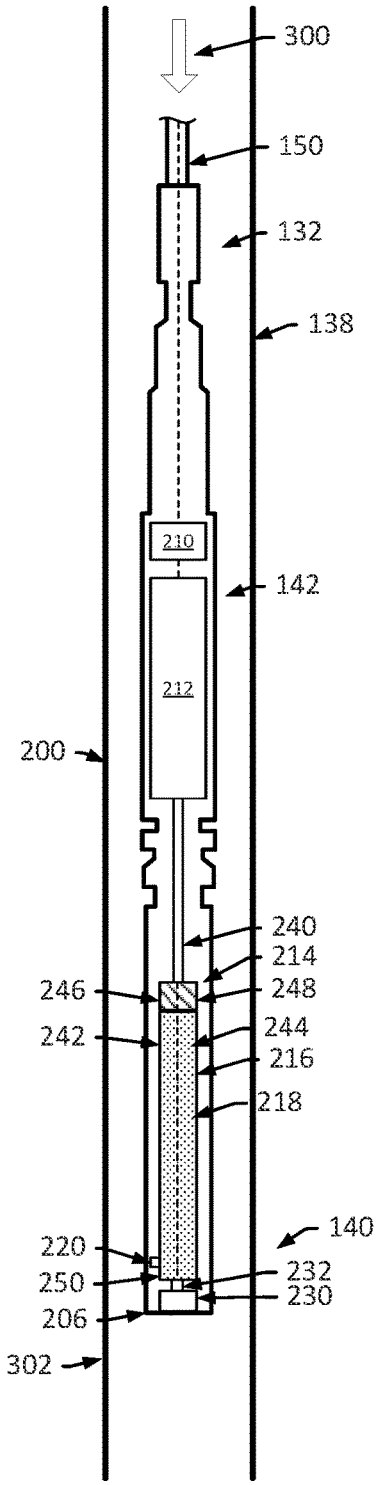
FIGS. 3A-3F are diagrams that illustrate employing the bridge plug system of FIG. 2 to install a bridge plug in a well in accordance with one or more embodiments.
Figure 3B:
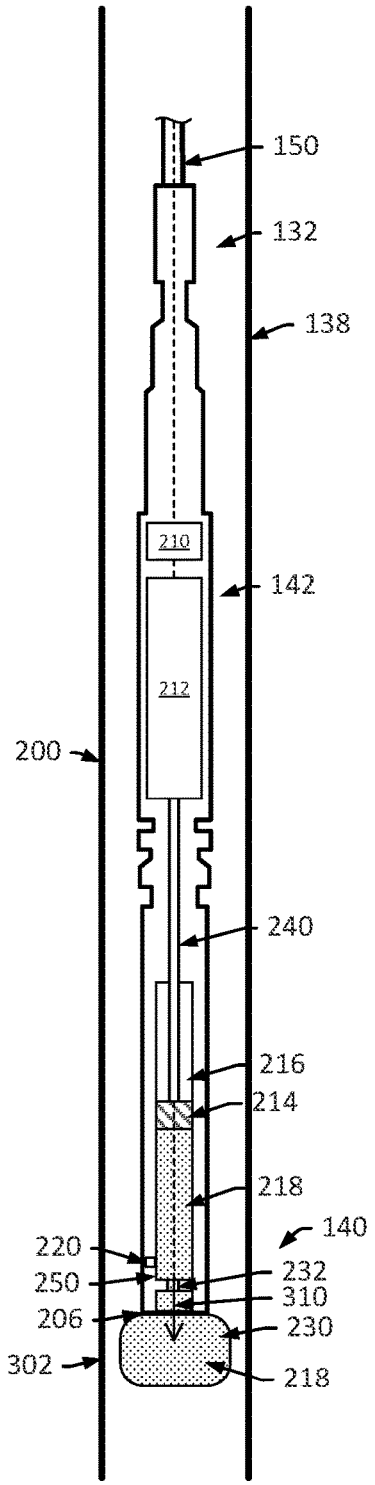
Figure 3C:
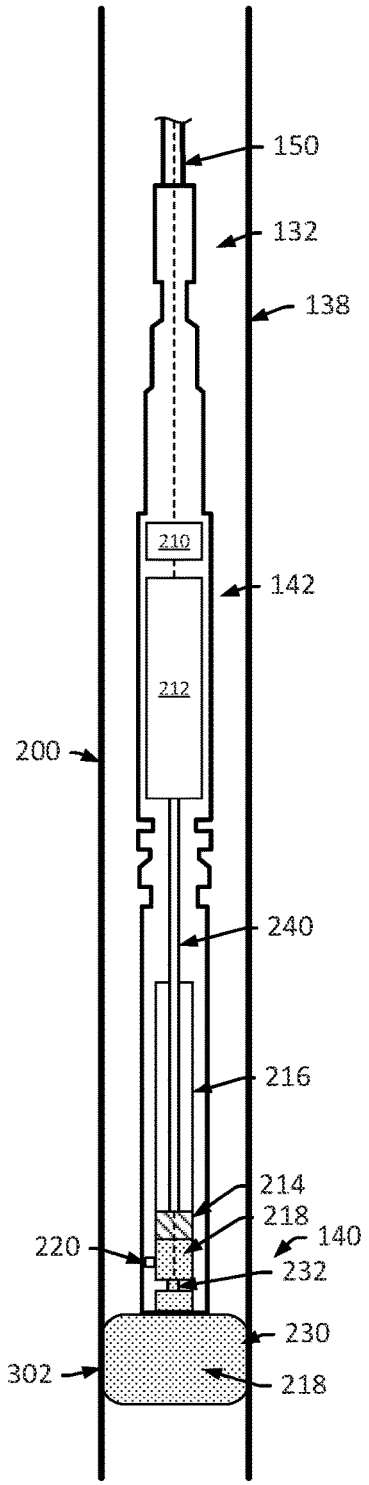
Figure 3D:
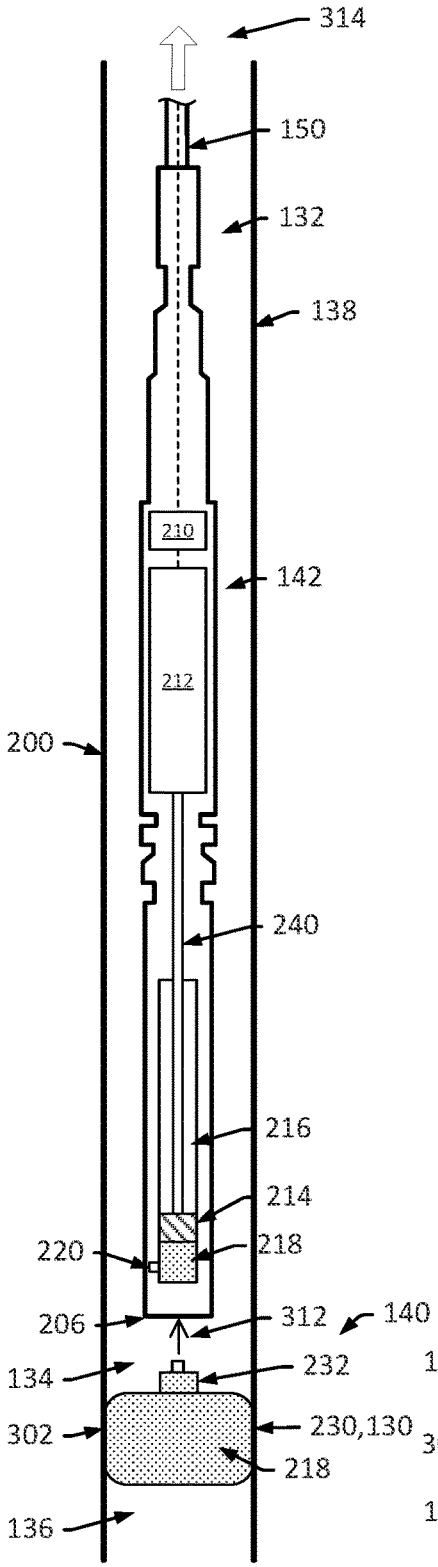
Figure 3E:
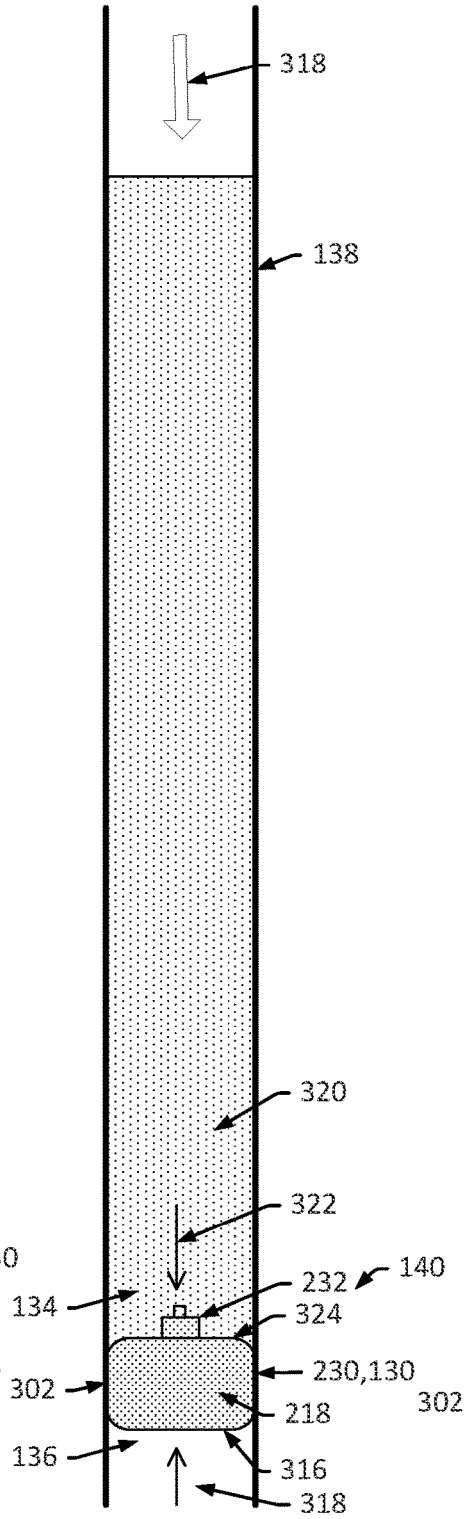
Figure 3F:
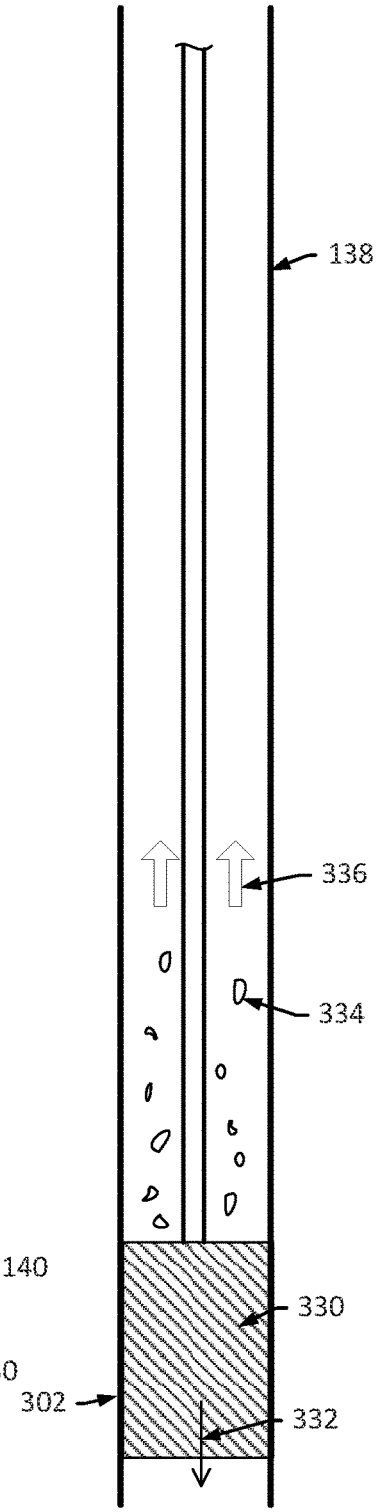

FIGS. 3A-3F are diagrams that illustrate employing the inflatable bridge plug system of FIG. 2 in a well 106 in accordance with one or more embodiments. FIG. 3A illustrates disposing the inflatable bridge plug 130 in the well 106 in accordance with one or more embodiments. FIGS. 3B and 3C illustrate deploying the inflatable bridge plug 130 in the well 106 in accordance with one or more embodiments. FIG. 3D illustrates retrieving a plug deployment system 142 from the well 106 and allowing the deployed, inflated bladder 230 to harden (or "cure") in the well 106 to form a hardened (or "cured") bridge plug 130 in accordance with one or more embodiments. FIG. 3E illustrates conducting a well operation (e.g., a workover including use of kill-fluid) in the well 106 with the hardened (or "cured") bridge plug 130 in the well 106 in accordance with one or more embodiments. FIG. 3E illustrates conducting a plug removal operation to remove the hardened (or "cured") bridge plug 130 from the well 106 in accordance with one or more embodiments.

Figure 4:
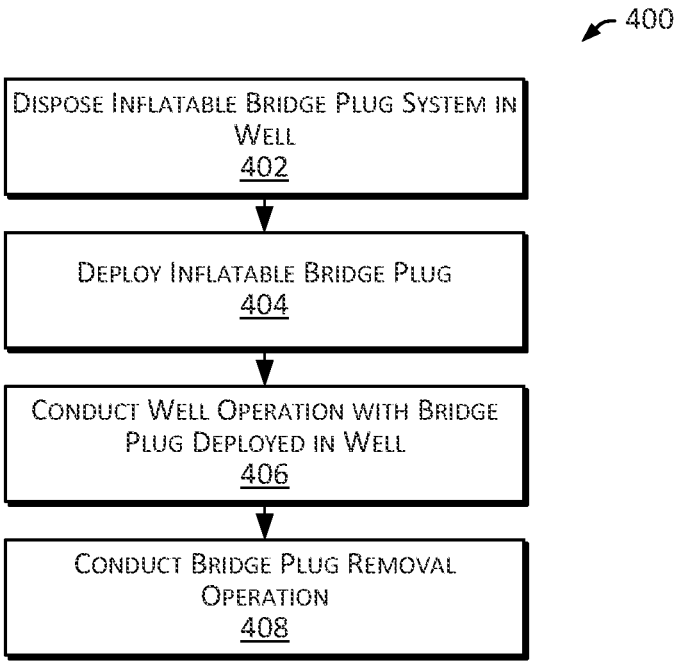
FIG. 4 is a flowchart that illustrates a method of employing an inflatable bridge plug in a well in accordance with one or more embodiments.

FIG. 4 is a flowchart that illustrates a method of employing an inflatable bridge plug in a well (e.g., including plugging a well with a bridge plug) in accordance with one or more embodiments. In some embodiments, some or all the operations described with regard to the well plug tool 132 may be executed or controlled by the onboard controller 210 or the well control system 124 (or another operator of the well 106).

In some embodiments, method 400 includes disposing an inflatable bridge plug system in a well (block 402). This may include running a downhole plug system (or "well plug tool") having an inflatable bridge plug, to a plug depth in a wellbore of a well. For example, as depicted at FIG. 3A, disposing an inflatable bridge plug system in a well may include the well control system 124 (or another operator of the well 106) controlling operation of the well 106 to lower (or "run") the downhole plug system (or "well plug tool") 132 down a production tubing tubular 138 of the well 106 (as indicated by the arrow 300), such that the downhole end 206 of the well plug tool 132 (and the bladder 230) is located at the plug depth 302 in the production tubing tubular 138. The well plug tool 132 may be supported by a wireline tether 150 at the surface, and this may include the well control system 124 (or another operator of the well 106) controlling extending (or "unspooling") of the wireline tether 150 to run the well plug tool 132 down the production tubing tubular 138.

In some embodiments, method 400 includes deploying an inflatable bridge plug in a well (block 404). This may include inflating the inflatable bridge plug with a hardening resin, detaching the bridge plug from the well plug tool, retrieving the well plug tool from the well and allowing the resin in the inflated bridge plug to harden (or "cure") to form a "hardened" (or "cured") bridge plug at the plug depth in the wellbore of the well. Continuing with the prior example, and as depicted at FIGS. 3B-3D, deploying an inflatable bridge plug in a well may include, the onboard controller 210, the well control system 124 (or another operator of the well 106) controlling of the well plug tool 132 to operate the motive device 212 to advance the piston 214 to urge resin 218 from the resin chamber 216, through the bladder valve 232 and into the inflatable bladder 230 to inflate the bladder 230 (see, e.g., arrow 310 of FIG. 3B), monitor pressure measured by the resin pressure sensor 220 and determine when the pressure meets or exceeds a resin pressure threshold (e.g., 200 psi) (see, e.g., FIGS. 3B and 3C) and, in response to determining that the resin pressure meets or exceeds the resin pressure threshold, control the motive device 212 to stop advancement of the piston 214 to stop further inflation of the bladder 230 with resin 218 (see, e.g., FIG. 3C). A corresponding "inflated" signal indicating that the resin pressure meets or exceeds the resin pressure threshold may be communicated to the well control system 124 (e.g., from the onboard controller 210 to the well control system 124 by way of the tether 150 or other communication). The well control system 124 may process the signal to determine that the pressure meets or exceeds the resin pressure threshold, and in response to the determination, operate the well 106 to raise the other portions of the well plug tool 132 (e.g., including the plug deployment system 142) upward in the well 106 (see, e.g., arrow 314 of FIG. 3D) to disconnect those portions of the well plug tool 132 from the plug bladder system 140 (see, e.g., arrow 312 of FIG. 3D), which leaves the inflated bladder 230 installed in the well 106. The installed (or "deployed") bladder 230 may, then, be allowed to sit relatively undisturbed for at least a hardening (or "curing") period that is sufficient to allow the resin in the inflated bridge plug to harden (or "cure") (e.g., for 1 hour or more) to form a "hardened" (or "cured") bridge plug 130 at the plug depth 302 in the production tubing tubular 138 of the well 106. This "hardened" (or "cured") bridge plug 130 may seal against the interior walls of production tubing tubular 138 at the plug depth to form barrier that isolates the upper region 134 of the production tubing tubular 138 (located above the bridge plug 130) from a lower region 136 of the production tubing tubular 138 (located below the bridge plug 130).

In some embodiments, method 400 includes conducting a well operation with the bridge plug deployed in the well (block 406). This may include performing an operation in the well, such a workover operation or other operation that relies on the isolation provided by the deployed bridge plug. Continuing with the prior example, conducting a well operation with the bridge plug deployed in the well may include the well control system 124 (or another operator of the well 106) controlling conducting of a workover operation in the upper region 134 of the production tubing tubular 138 (located above the bridge plug 130). With reference to FIG. 3E, in an instance where it is desirable to offset pressure (e.g., production or other fluid pressure) in the lower region 136 of the production tubing tubular 138 acting on a bottom side 316 of the bridge plug 130 (illustrated by arrow 318), the workover operation may include controlling a fluid system of the well 106 to deposit (e.g., pump) a column of kill fluid (e.g., mud) 320 into the upper region 134, on top of the bridge plug 130, such that the weight of the kill fluid (illustrated by arrow 322) acts against a top side 324 of the installed bridge plug 130 to offset the pressure acting on the bottom side 316 of the installed bridge plug 130.

In some embodiments, method 400 includes conducting a bridge plug removal operation in the well (block 408). This may include performing an operation that includes partially or completely removing a bridge plug installed in the well to establish communication between the regions (or "zones") on either side of the bridge plug. Continuing with the prior example, conducting a bridge plug removal operation in the well may include conducting of a plug removal operation that includes removing the bridge plug 130 so that communication is reestablished between the upper and lower regions 134 and 136 of the production tubing tubular 138. This may include, for example, the well control system 124 (or another operator of the well 106) controlling a drilling system of the well 106 to drill-out the bridge plug 130. Referencing FIG. 3F, the operation may include lowering a drilling tool 330 into the wellbore 120 (e.g., down the tubular 138) to drill though (or "drill-out") the installed bridge plug 130 (as indicated by arrow 332). The resulting debris of the drilling operation, including remaining parts of the bridge plug 334, may be carried up and out of the wellbore 120 by way of drilling fluid (e.g., in drilling fluid circulated through the drilling tool) (as indicated by arrows 336).

Figure 5:
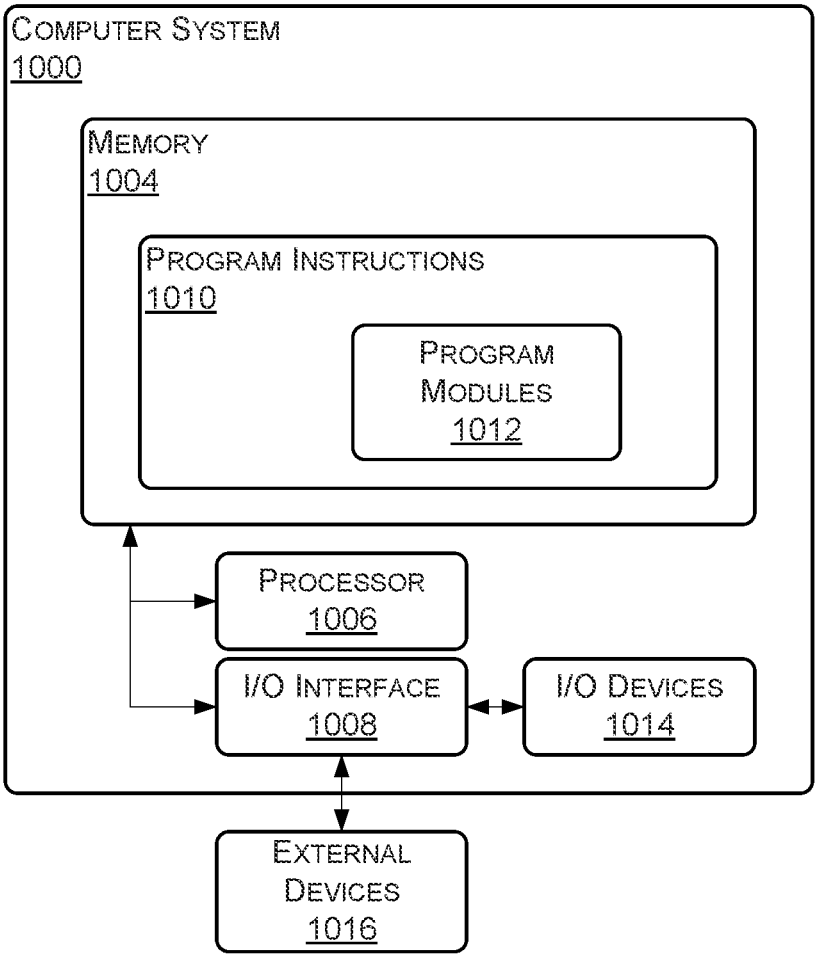
FIG. 5 is a diagram that illustrates an example computer system in accordance with one or more embodiments.

FIG. 5 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random-access memory (SRAM), synchronous dynamic RAM (SDRAM)), or bulk storage memory (e.g., CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., by the processor 1006) to cause the functional operations described, such as those described with regard to the onboard controller 210, the well control system 124 (or another operator of the well 106), or the method 400.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. The external devices 1016 may include, for example, devices of the well system 106 or the well plug tool 132.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all the portions of the processes and methods may be implemented by one or more of the processors/modules/applications described here.

As used throughout this application, the word "may" is used in a permissive sense (that is, meaning having the potential to), rather than the mandatory sense (that is, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A well plug system comprising:

a downhole plug system configured to be disposed downhole in a well, the downhole plug system comprising:

a plug bladder system comprising:

an inflatable bladder configured to be inflated with a resin; and a check valve configured to facilitate flow of the resin into the inflatable bladder and to inhibit back flow of the resin out of the inflatable bladder, wherein the check valve comprises a snap connector;

a resin pressure sensor configured to measure a pressure of the resin;

a relief valve employable to release pressure in the bladder to deflate the bladder; and a plug deployment system comprising:

a resin chamber configured to house the resin and comprising an outlet, wherein the outlet comprises a connector configured to couple to the snap connector of the check valve, such that the plug bladder system may be selectively coupled and decoupled from the plug deployment system;

a resin deployment system comprising a piston configured to urge the resin to flow from the resin chamber, through the check valve and into the inflatable bladder while the downhole plug system is disposed downhole in the well to inflate the plug bladder system into sealing contact with a surrounding downhole portion of the well; and a motive device comprising a pinion that engages a rack of a stem coupled to the piston;

an onboard controller configured to control operation of the motive device to regulate advancement of the piston, wherein the onboard controller is further configured to:

determine, based on a measurement of the pressure of the resin obtained by way of the resin pressure sensor, that the pressure of the resin satisfies a resin pressure threshold, in response to determining that the pressure of the resin satisfies the resin pressure threshold, inhibit flow of the resin into the inflatable bladder by stopping advancement of the piston, the resin comprising a hardening resin configured to harden inside of the inflatable bladder to form a hardened plug downhole in the well.

2. The system of claim 1, wherein the plug deployment system is configured to detach from the plug bladder system such that the plug deployment system can be detached from the plug bladder system and retrieved from the well with the plug bladder system remaining inflated and disposed downhole in the well.

3. The system of claim 1, wherein the resin comprises a two-part hardening composition comprising a curing agent component and a resin component, wherein the downhole plug system is configured to isolate the curing agent component from the resin component while the resin is housed in resin chamber, and the downhole plug system is configured to combine the curing agent component and the resin component such that the resin hardens inside the inflatable bladder.

4. The system of claim 1, wherein the well plug system comprises a well control system coupled to the plug deployment system by way of a tether and configured to control operation of the plug deployment system.

5. The system of claim 1, wherein the well comprises a hydrocarbon well comprising downhole tubing disposed in a wellbore of the hydrocarbon well and wherein the downhole plug system is configured to be disposed in the downhole tubing and the plug bladder system is configured to be inflated into sealing contact with an interior surface of the downhole tubing.

6. A method of plugging a well, the method comprising:

disposing a downhole plug system downhole in a well, the downhole plug system comprising:

a plug bladder system comprising:

an inflatable bladder configured to be inflated with a resin; and a check valve configured to facilitate flow of the resin into the inflatable bladder and to inhibit back flow of the resin out of the inflatable bladder, wherein the check valve comprises a snap connector;

a resin pressure sensor configured to measure a pressure of the resin;

a relief valve employable to release pressure in the bladder to deflate the bladder; and a plug deployment system comprising:

a resin chamber configured to house the resin and comprising an outlet, wherein the outlet comprises a connector configured to couple to the snap connector of the check valve, such that the plug bladder system may be selectively coupled and decoupled from the plug deployment system; and a resin deployment system;

a piston; and a motive device comprising a pinion that engages a rack of a stem coupled to the piston;

controlling the plug deployment system to urge the resin to flow from the resin chamber, through the check valve and into the inflatable bladder while the downhole plug system is disposed downhole in the well to inflate the plug bladder system into sealing contact with a surrounding downhole portion of the well, the resin comprising a hardening resin configured to harden inside of the inflatable bladder to form a hardened plug downhole in the well, wherein controlling the plug deployment system to urge the resin to flow from the resin chamber comprises advancing the piston, wherein advancing the piston comprises controlling the motive device to regulate the advancement of the piston; and determining, based on a measurement of the pressure of the resin obtained by way of the resin pressure sensor, that the pressure of the resin satisfies a resin pressure threshold, and in response to determining that the pressure of the resin satisfies the resin pressure threshold, inhibiting flow of the resin into the inflatable bladder by stopping advancement of the piston, wherein the resin hardens inside of the inflatable bladder to form a hardened plug downhole in the well.

7. The method of claim 6, further comprising:

detaching the plug deployment system from the plug bladder system; and retrieving the plug deployment system from the well, leaving the plug bladder system inflated and disposed downhole in the well.

8. The method of claim 6, wherein the resin comprises a two-part hardening composition comprising a curing agent component and a resin component, wherein the downhole plug system isolates the curing agent component from the resin component while the resin is housed in resin chamber, and the downhole plug system combines the curing agent component and the resin component such that the resin hardens inside the inflatable bladder.

9. The method of claim 6, wherein the well comprises a hydrocarbon well comprising downhole tubing disposed in a wellbore of the hydrocarbon well, wherein disposing the downhole plug system downhole in the well comprises disposing the downhole plug system in the downhole tubing, wherein the plug bladder system inflated into sealing contact with an interior surface of the downhole tubing, and wherein the hardening of the resin forms a hardened plug in the downhole tubing.

10. The method of claim 6, further comprising conducting a well operation in the well with the hardened plug downhole in the well.

11. The method of claim 6, further comprising conducting a plug removal operation comprising drilling through the hardened plug.

12. A non-transitory computer readable storage medium comprising program instructions stored thereon that are executable by a processor to perform the following operations for plugging a well:

controlling disposing of a downhole plug system downhole in a well, the downhole plug system comprising:

a plug bladder system comprising:

an inflatable bladder configured to be inflated with a resin; and a check valve configured to facilitate flow of the resin into the inflatable bladder and to inhibit back flow of the resin out of the inflatable bladder, wherein the check valve comprises a snap connector;

a resin pressure sensor configured to measure a pressure of the resin;

a relief valve employable to release pressure in the bladder to deflate the bladder; and a plug deployment system comprising:

a resin chamber configured to house the resin and comprising an outlet, wherein the outlet comprises a connector configured to couple to the snap connector of the check valve, such that the plug bladder system may be selectively coupled and decoupled from the plug deployment system; and a resin deployment system;

a piston; and a motive device comprising a pinion that engages a rack of a stem coupled to the piston;

controlling the plug deployment system to urge the resin to flow from the resin chamber, through the check valve and into the inflatable bladder while the downhole plug system is disposed downhole in the well to inflate the plug bladder system into sealing contact with a surrounding downhole portion of the well, the resin comprising a hardening resin configured to harden inside of the inflatable bladder to form a hardened plug downhole in the well, wherein controlling the plug deployment system to urge the resin to flow from the resin chamber comprises advancing the piston, wherein advancing the piston comprises controlling the motive device to regulate the advancement of the piston; and determining, based on a measurement of the pressure of the resin obtained by way of the resin pressure sensor, that the pressure of the resin satisfies a resin pressure threshold, and in response to determining that the pressure of the resin satisfies the resin pressure threshold, inhibiting flow of the resin into the inflatable bladder by stopping advancement of the piston, wherein the resin is configured to harden inside of the inflatable bladder to form a hardened plug downhole in the well.

13. The medium of claim 12, the operations further comprising:

controlling detachment of the plug deployment system from the plug bladder system; and controlling retrieving of the plug deployment system from the well to leave the plug bladder system inflated and disposed downhole in the well.

* * * * *